US006009706A

United States Patent [19]

Haneda

[11] Patent Number: 6,009,706

[45] Date of Patent: Jan. 4, 2000

[54] EXHAUST MANIFOLD ASSEMBLY IN AN INTERNAL COMBUSTION ENGINE

[75] Inventor: Hiroaki Haneda, Shizuoka-ken, Japan

[73] Assignee: Suzuki Motor Corporation, Shizuoka-ken, Japan

[21] Appl. No.: 09/087,387

[22] Filed: May 29, 1998

[30] Foreign Application Priority Data

May 30, 1997 [JP] Japan ..... 9-157427

[51] Int. Cl.[7] ..... F01N 7/10

[52] U.S. Cl. ..... 60/323; 60/322; 60/272

[58] Field of Search ..... 60/323, 301, 322, 60/272

[56] References Cited

U.S. PATENT DOCUMENTS

| | | | |
|---|---|---|---|
| 4,022,019 | 5/1977 | Garcea | 60/282 |
| 5,572,868 | 11/1996 | Okamoto et al. | 60/323 |
| 5,606,857 | 3/1997 | Harada | 60/322 |
| 5,689,954 | 11/1997 | Blocker et al. | 60/322 |

FOREIGN PATENT DOCUMENTS

| | | | |
|---|---|---|---|
| 0380407 | 8/1990 | European Pat. Off. | 7/8 |
| 64-51719 | 3/1989 | Japan . | |
| 2-103121 | 8/1990 | Japan . | |
| 4-269322 | 9/1992 | Japan . | |
| 5-14524 | 2/1993 | Japan . | |
| 7-24576 | 6/1995 | Japan . | |

*Primary Examiner*—Thomas Denion
*Assistant Examiner*—Binh Tran
*Attorney, Agent, or Firm*—Flynn, Thiel, Boutell & Tanis, P.C.

[57] ABSTRACT

An exhaust manifold assembly including a one-point junction type exhaust manifold, whereby the occurrence of exhaust interference is prevented by a large capacity portion formed at a junction of the branch pipes. The large capacity portion has a capacity larger than the capacity of each branch pipe. Both torque and output can be improved, the size of the exhaust manifold can be reduced, and layout restrictions can be eliminated. The exhaust manifold assembly includes an exhaust manifold attached to the internal combustion engine, the internal combustion engine having a plurality of cylinders, and a manifold cover disposed to shut out heat and sound from the exhaust manifold. the exhaust manifold also includes branch pipes respectively provided with branched exhaust passages in communication with exhaust ports of the internal combustion engine, wherein the exhaust manifold is a one-point junction type manifold, and a large capacity portion is formed at a junction of the branch pipes, the large capacity portion having a capacity larger than the capacity of each branch pipe.

12 Claims, 10 Drawing Sheets

EX manifold (B)

EX manifold (C)

EX manifold (D)

EX manifold (E)

FIG. 9

| Comparison model name | EX manifold type | Torque improvement (3500–5000rpm) | Effect |
|---|---|---|---|
| EX manifold (B)<br>Diameter of 1st branch pipe 40mm<br>Others 32mm | Ladder type | 4.0 % | × |
| EX manifold (C)<br>Diameter of all pipes 32mm | Ladder type | 0 (standard) | × |
| EX manifold (D)<br>Pipe diameter from junction to catalyst 40mm → 60mm | One–point junction type | 5.6 % | △ |
| EX manifold (E)<br>EX manifold with large capacity portion | One–point junction type | 6.4 % | ○ |

EXHAUST MANIFOLD ASSEMBLY IN AN INTERNAL COMBUSTION ENGINE

FIELD OF THE INVENTION

The present invention relates to an exhaust manifold assembly in an internal combustion engine. Particularly, the invention is concerned with an exhaust manifold assembly in an internal combustion engine having a one-point junction type exhaust manifold and also having a large capacity portion formed at a junction of branch pipes, which large capacity portion has a capacity larger than the capacity of each branch pipe so that it is possible to eliminate exhaust interference, improve torque and output, reduce the size of the exhaust manifold, and reduce restrictions on layout.

BACKGROUND OF THE INVENTION

In an internal combustion engine mounted on a vehicle or the like, an exhaust manifold assembly is provided for the discharge of exhaust gas. The exhaust manifold assembly has branch pipes of a number matching the number of cylinders in the engine, and a junction where the branch pipes are joined. Branched exhaust passages formed in the branch pipes are respectively in communication with exhaust ports.

In Japanese Patent Laid-Open No. 4-269322 an exhaust manifold assembly in an internal combustion engine is disclosed. According to this exhaust manifold assembly, in an internal combustion engine having a plurality of cylinders, one junction point is used for junction of branch pipes corresponding to the cylinders to a junction pipe, and each of the branch pipes are arranged so as to intersect the junction pipe at a specified angle, thereby improving the output without exhaust interference.

In Japanese Utility Model Publication No. 7-24576 a catalytic converter in an exhaust manifold is disclosed. According to this catalytic converter, a metal carrier with a catalyst carried therein is inserted and fixed into a cylinder shell. A first case for connection to the exhaust manifold side is fitted in an upstream portion of the cylindrical shell, and a downstream end of the first case and the shell are bonded together by full-circle welding, while a second case for connection to an exhaust pipe is fitted in a downstream portion of the shell and an upstream end of the second case and the shell are bonded together by full-circle welding. The fitting allowance or clearance between the first case and the shell is set larger than the fitting allowance between the second case and the shell.

Reference is further made to Japanese Utility Model Laid-Open No. 64-51719, which also discloses an exhaust manifold structure in an engine. This exhaust manifold structure comprises a first branch passage group having a junction on a downstream side and connected to a first group of cylinders having non-continuous intake strokes, a second branch passage group having a junction on a downstream side and connected to a second group of cylinders having non-continuous intake strokes, and a final junction contiguous to both the junction of the first branch passage group and the junction of the second passage group. The first branch passage group is disposed in front of an engine body, the second branch passage group is disposed between the first branch passage group and the engine body, and an expanded portion which constitutes an expansion chamber is formed over the area from the second branch passage group to the final junction.

In Japanese Utility Model Laid-Open No. 2-103121 an exhaust manifold structure for a multi-cylinder engine is disclosed which has a plurality of exhaust passages connected cylinder by cylinder to the body side of the engine and also has junctions formed at downstream ends of the exhaust passages to join the downstream sides of the exhaust passages into a smaller number of exhaust passages than the number of cylinders. This exhaust manifold structure is of the type in which exhaust passages of a group of exhaust passages overlap one another in a mutually intersecting manner. One of the overlapped exhaust passages has a rib extending substantially along the axis of the other exhaust passage. According to a similar type of an exhaust manifold structure for an engine, a rib is formed between two substantially parallel exhaust passages so as to extend up to an outside position beyond the center of at least one of the two exhaust passages.

Further, in Japanese Utility Model Laid-Open No. 5-14524 an exhaust manifold assembly is disclosed in which a joined position of cylinder exhaust pipes in a multi-cylinder four-cycle engine is opened to form an empty chamber.

Heretofore, exhaust manifold assemblies of various structures have been developed in an effort to prevent a decrease of engine torque and output caused by exhaust interference from the internal combustion engine.

For example, as shown in FIG. 16., a known exhaust manifold 102 is formed as a one-point junction type by first to fourth branch pipes 104-1, 104-2, 104-3 and 104-4, as independent ports, and a junction 132 where those four branch pipes are joined. The first to fourth branch pipes 104-1, 104-2, 104-3 and 104-4 are formed long so as to be of substantially the same length.

However, the structure for the elimination of exhaust interference requires the four branch pipes to be long and thus layout restrictions are great, giving rise to the inconvenience that it is impossible to make an effective utilization of space.

In the known exhaust manifold structure shown in FIG. 17, an exhaust manifold 202 comprises first to fourth branch pipes 204-1, 204-2, 204-3 and 204-4 and a junction 232 where those four branch pipes are joined. In the same structure, non-interfering ports, namely, two ports which are not continuous (that is, the cylinders connected to these two ports are not directly fired in sequence one after the other), are joined in accordance with ignition order. More particularly, the first and fourth branch pipes 204-1, 204-4 are joined, and the second and third branch pipes 204-2, 204-3 are joined, followed by being combined together in the junction 232.

As a result, the structure of the junction and that of the vicinity thereof becomes somewhat more compact, but this arrangement is disadvantageous in practical use because it still occupies a large space.

Further, in the known exhaust manifold structure shown in FIG. 18, a single stainless steel pipe is bent in an L-shape to form a first branch pipe 304-1 and a main pipe 334, and second to fourth branch pipes 304-2, 304-3 and 304-4 are connected to the main pipe 334 to form a ladder-shaped (or ladder type) exhaust manifold 302. The first branch pipe 304-1 is larger in diameter than the second to fourth branch pipes 304-2, 304-3 and 304-4. The reference numeral 306 denotes a cylinder head-side mounting flange portion formed by a steel plate, numeral 308 denotes an exhaust pipe-side mounting flange portion formed by a steel plate, numeral 312 denotes an EGR (exhaust gas recirculation) pipe, numeral 314 denotes a stud bolt, numeral 316 denotes a catalyst case disposed just under the exhaust manifold 302, and numeral 318 denotes an exhaust pipe.

However, in the manifold converter type with the catalyst case disposed just under the exhaust manifold, as shown in FIG. 18, exhaust interference cannot be eliminated due to layout restrictions.

As to an exhaust manifold cover which is mounted for shutting out heat and sound from the exhaust manifold, as shown in FIGS. 19 and 20, an exhaust manifold cover 122 is in many cases formed by a plurality of joined planar portions. This shape is inferior in both strength and appearance as compared with a streamlined shape.

Further, in the exhaust manifold cover 122 there is virtually no planar portion which extends in the horizontal direction, and hence there is no space for the placement of information such as instructions or an operating method. This is disadvantageous in practical use.

SUMMARY OF THE INVENTION

According to the present invention, to eliminate or minimize the above-mentioned inconveniences, there is provided an exhaust manifold assembly in an internal combustion engine having an exhaust manifold attached to the internal combustion engine, the internal combustion engine having a plurality of cylinders, and a manifold cover is disposed to shut out heat and sound from the exhaust manifold. The exhaust manifold has branch pipes respectively provided with branched exhaust passages in communication with exhaust ports of the internal combustion engine. The exhaust manifold is a one-point junction type manifold in which a large capacity portion is formed at the junction of the branch pipes, which large capacity portion has a capacity larger than the capacity of each branch pipe.

With the large capacity portion in the exhaust manifold assembly constructed as discussed above, exhaust interference is eliminated, torque and output are improved, the size of the exhaust manifold is reduced, and layout restrictions are eliminated.

BRIEF DESCRIPTION OF THE DRAWINGS

Embodiments of the present invention will be described hereinafter with reference to the drawings, in which:

FIG. 9 is a diagram showing a comparison of effects among the EX manifolds;

DETAILED DESCRIPTION

Figure 1:
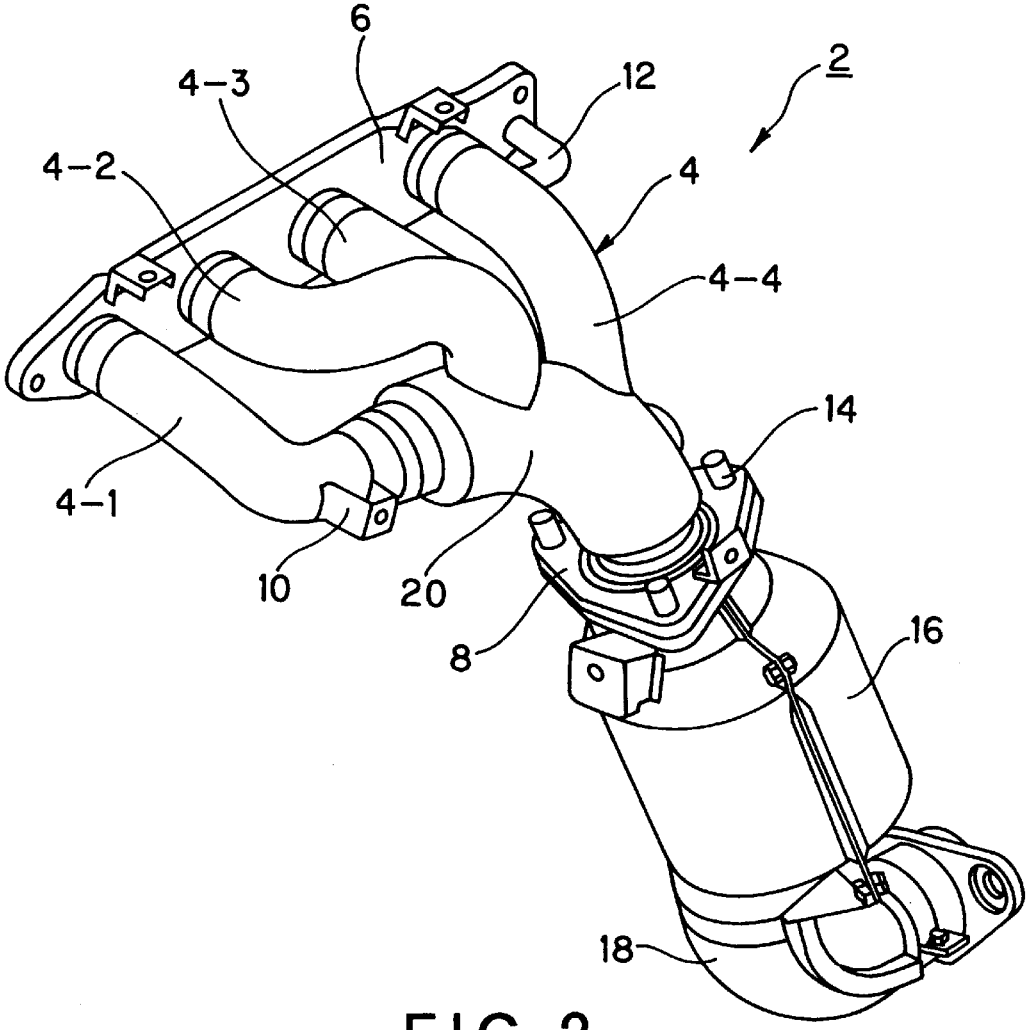
FIG. 1 is a schematic perspective view of an exhaust manifold assembly in an internal combustion engine according to a first embodiment of the present invention.

FIGS. 1 to 10 illustrate a first embodiment of the present invention. In FIG. 1, the numeral 2 denotes a one-point junction type exhaust manifold which is attached to an internal combustion engine (not shown) having a plurality, e.g. four, of cylinders, and numeral 4 denotes a branch pipe.

On an upstream side of the exhaust manifold 2 a cylinder head-side mounting flange 6 formed by a steel plate is provided, while on a downstream side of the exhaust manifold 2 an exhaust pipe-side mounting flange 8 also formed by a steel plate is provided.

The exhaust manifold 2 has branch pipes 4, for example four designated as first to fourth branch pipes 4-1, 4-2, 4-3 and 4-4, which are internally provided with branched exhaust passages (not shown) respectively in communication with exhaust ports (not shown) of the internal combustion engine.

An exhaust manifold cover (not shown) is attached to a mounting portion 10 of the exhaust manifold 2 to shut out heat and sound from the exhaust manifold 2.

The numeral 12 denotes an EGR (exhaust gas recirculation) passage pipe connected to the cylinder head-side mounting flange 6, numeral 14 denotes a stud bolt fixed in the exhaust pipe-side mounting flange 8, numeral 16 denotes a catalyst case mounted just under the exhaust manifold 2, that is, just downstream of the exhaust manifold 2, and numeral 18 denotes an exhaust pipe.

Further, a large capacity pipe portion 20 having a capacity (i.e., cross sectional flow area) larger than the capacity of each of the first to fourth branch pipes 4-1, 4-2, 4-3 and 4-4 is provided at the junction of the four branch pipes.

More specifically, the large capacity pipe portion 20 has a tubular shape and extends in a direction toward the branch pipes whereby the upstream side is remote from the downstream side, namely, in the direction of the first branch pipe 4-1, to make the first to fourth branch pipes 4-1, 4-2, 4-3 and 4-4 almost equal in length. The large capacity pipe portion 20 has an interior passage diameter larger than the interior passage diameter of each of branch exhaust pipes 4-1 through 4-4.

In other words, the large capacity pipe portion 20 is curved in the direction of the first branch pipe 4-1, and the upstream end thereof connects to the first branch pipe 4-1.

In the exhaust manifold 2, the first to fourth branch pipes 4-1, 4-2, 4-3 and 4-4 are connected to the large capacity pipe portion 20 after joining two of the four branch pipes, e.g. 4-2 and 4-3, to one another.

Figure 2:
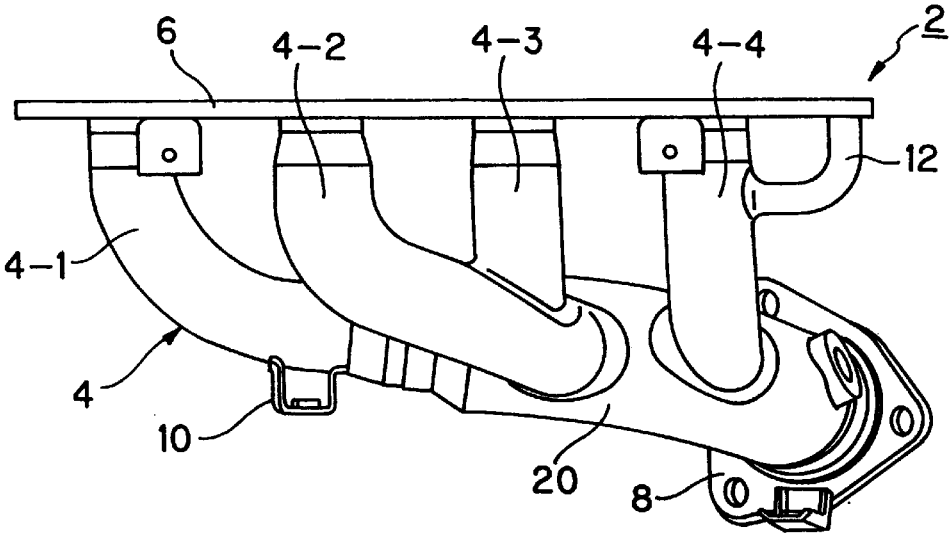
FIG. 2 is a plan view thereof.
Figure 3:
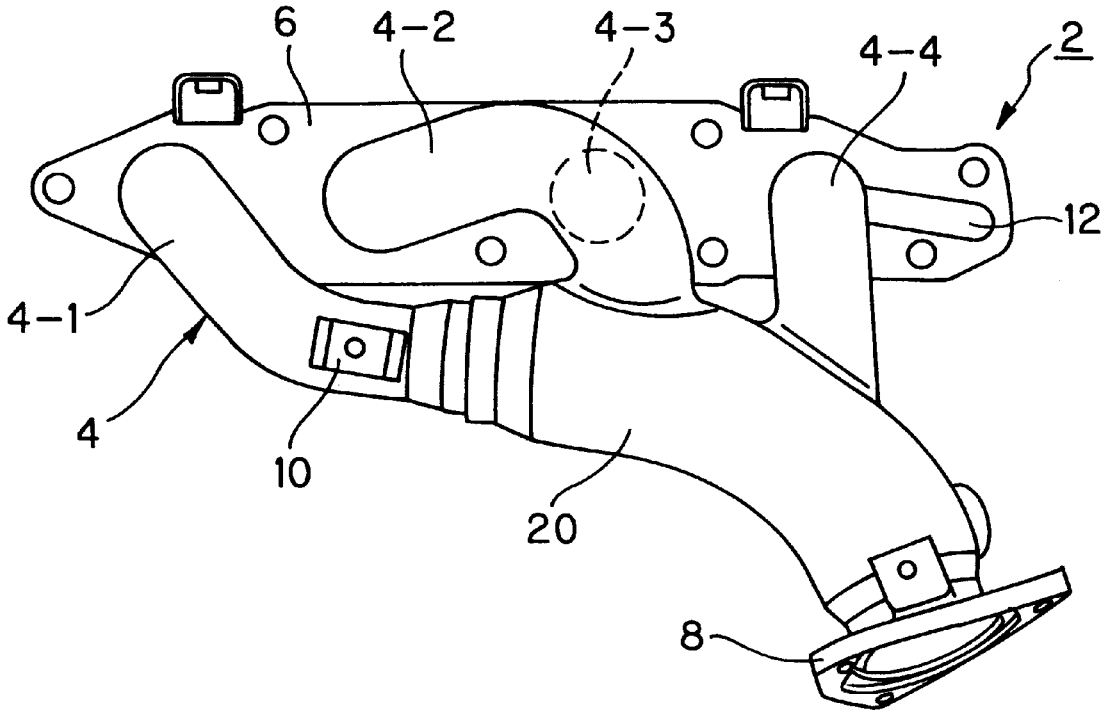
FIG. 3 is a front view thereof.

As shown in FIGS. 1 to 3, the third branch pipe 4-3 is combined with the second branch pipe 4-2 at an intermediate position on the branch pipe 4-2, and the interior passage of the second branch pipe 4-2 is made larger in diameter than the interior passages of the first, third and fourth branch pipes 4-1, 4-3, 4-4. Further, the diameter of the interior passage of the second branch pipe 4-2 is smaller than the diameter of the interior passage formed in the large capacity pipe portion 20.

The second and third branch pipes 4-2 and 4-3, and the fourth branch pipe 4-4 connect to the large capacity pipe portion 20 along the curved length thereof.

Four types of exhaust manifolds (hereinafter also referred to as "EX manifold") are provided, and a comparison is made below relating to the effects caused by the different exhaust manifold structures.

Figure 4:
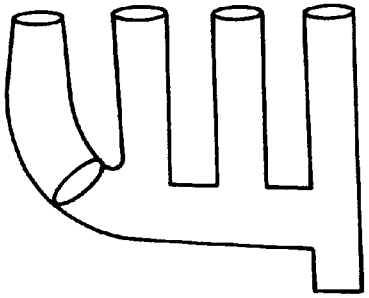
FIG. 4 is a schematic diagram of one EX manifold.

As shown in FIG. 4, an EX manifold (B) as a first example of an exhaust manifold is a ladder type manifold, in which the diameter of a first branch pipe is set at 40 mm, while the diameter of each of the second to fourth branch pipes is set at 32 mm.

Figure 5:
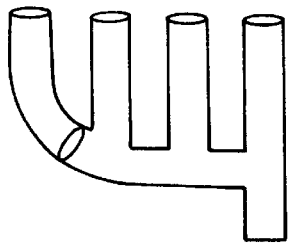
FIG. 5 is a schematic diagram of another EX manifold.

An EX manifold (C) as a second example of an exhaust manifold, as shown in FIG. 5, is also a ladder type manifold. In the EX manifold (C), first to fourth branch pipes are all 32 mm in diameter.

Figure 6:
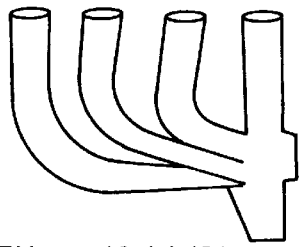
FIG. 6 is a schematic diagram of a further EX manifold.

An EX manifold (D) as a third example of an exhaust manifold, as shown in FIG. 6, is a one-point junction type manifold, in which the pipe diameter from the junction to the ends of the pipes associated with the exhaust ports changes from 40 mm to 60 mm.

Figure 7:
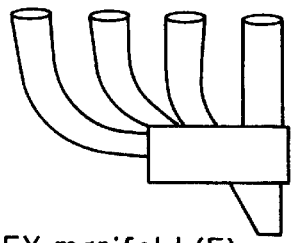
FIG. 7 is a schematic diagram of an EX manifold according to the first embodiment.

An EX manifold (E) as a fourth example of an exhaust manifold, as shown in FIG. 7, is a one-point junction type manifold like EX manifold (D), and a large capacity pipe portion is formed at the junction as in the present embodiment of the invention.

Figure 8:
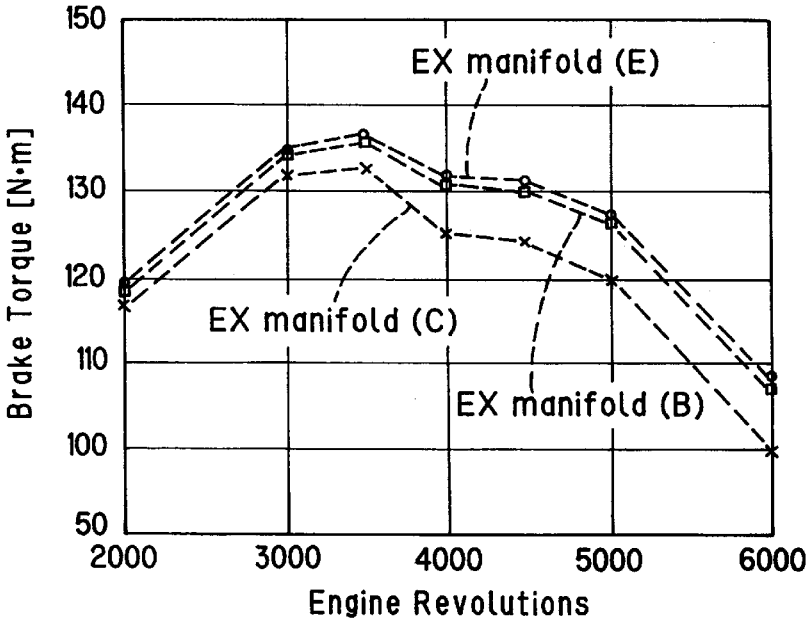
FIG. 8 is a diagram showing a relation between engine revolutions and brake torque for the different EX manifolds.
Figure 10:
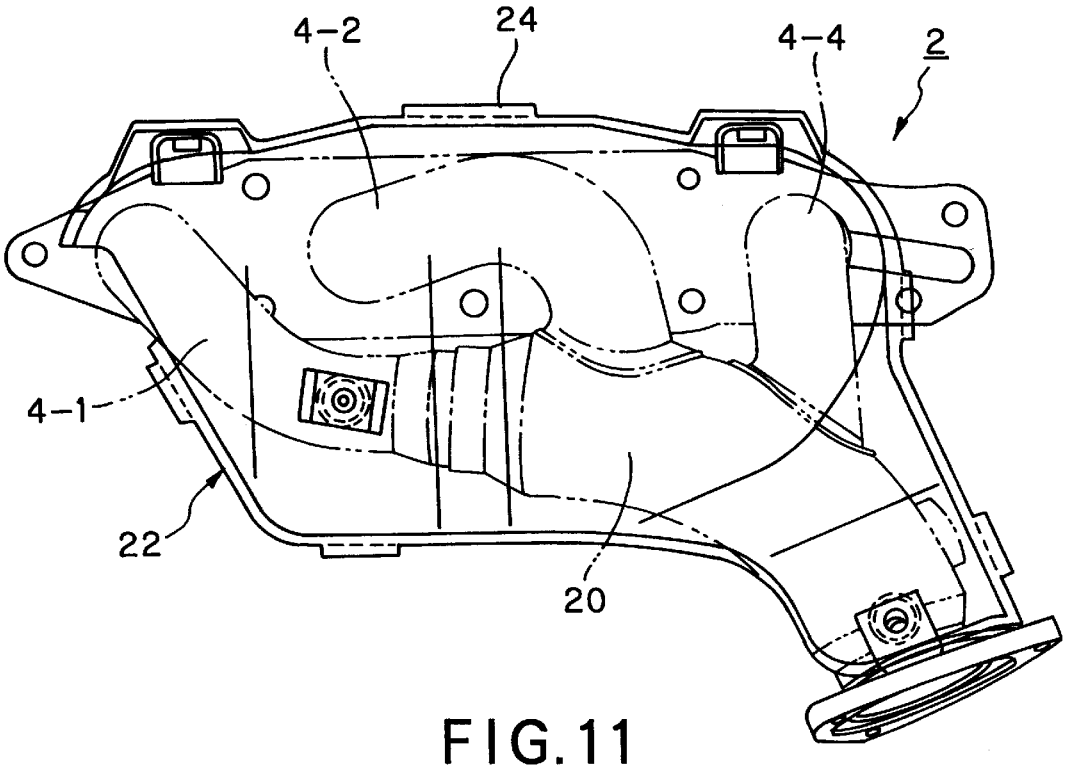
FIG. 10 is a front view of an exhaust manifold and an exhaust manifold cover as attached to the exhaust manifold, according to a second embodiment of the present invention.

As is apparent from FIGS. 8 and 9, the configuration of the EX manifold (E) results in improved torque, wherein the symbols "○", "Δ" and "X" shown in FIG. 9 represent greatest to least exhaust manifold effectiveness in that order.

From the above result it is apparent that even if the size of an exhaust manifold is reduced, if some improvement is made with respect to its shape and if a large capacity portion is formed, it becomes possible to fabricate an exhaust manifold improved in performance as compared with the standard model.

As shown in FIG. 9, the torque improvement value of 6.4% in EX manifold (E) was obtained by calculation at an engine revolution of approximately 4000 rpm in FIG. 8 with EX manifold (C) as a base. The torque improvement value for EX manifold (E) was obtained using the following equation wherein "N·m" denotes the Newton-meter unit of torque:

$$(10[\mathrm{N}\cdot m]-2[\mathrm{N}\cdot m])/125[\mathrm{N}\cdot m]\times 100=6.4$$

The operation and advantages of this embodiment will be summarized below.

While the internal combustion engine is in operation, exhaust gases discharged from the cylinders of the engine pass through the first to fourth branch pipes 4-1, 4-2, 4-3 and 4-4 of the exhaust manifold 2 and reach the large capacity pipe portion 20 as a junction of the four branch pipes. At this time, exhaust interference is prevented by the large capacity of the pipe portion 20, and hence the decrease of torque and that of output are prevented.

Thus, since the large capacity pipe portion 20, which is larger in flow capacity than the branch pipes 4, is disposed at the junction of branch pipes 4 in the exhaust manifold 2 of one-point junction type, it is possible to eliminate exhaust interference and improve both torque and output, which is advantageous in practical use.

Moreover, the provision of the large capacity pipe portion 20 in the exhaust manifold 2 permits the reduction in size, or length, of the exhaust manifold 2, and therefore it becomes possible to diminish the occupied space as a whole. Even if the catalyst case 16 is positioned just under the exhaust manifold 2 to realize a manifold-converter arrangement in order to conform to the emission regulations, there is no problem due to layout restrictions.

Moreover, since the large capacity pipe portion 20 is formed in a tubular shape extending in a direction in which the upstream end is remote from the downstream end, namely, in the direction of the first branch pipe 4-1, and the interior passage (not shown) formed in the large capacity pipe portion 20 is larger in diameter than the branched interior exhaust passages (not shown) of the first to fourth branch pipes 4-1, 4-2, 4-3 and 4-4, the four branch pipes can be made almost equal in length and it becomes possible to eliminate exhaust interference, avoid a decrease in both torque and output caused by exhaust interference, and thereby improve both torque and output.

Further, since the exhaust manifold 2 is formed in such a manner that two of the first to fourth branch pipes 4-1, 4-2, 4-3 and 4-4, e.g. the second and third branch pipes 4-2, 4-3, are joined to one another and thereafter connected to the large capacity pipe portion 20, it is possible to make the four branch pipes almost equal in length and thus contribute to the prevention of exhaust interference.

FIGS. 10 to 15 illustrate a second embodiment of the present invention, in which the portions fulfilling the same functions as in the above first embodiment are identified by like reference numerals.

The second embodiment includes an exhaust manifold cover 22 for covering the exhaust manifold 2, which cover 22 is formed in conformity with the shapes of the first to fourth branch pipes 4-1, 4-2, 4-3 and 4-4, and a planar portion 24 for the placement of information or a notice is formed on an upper part of the cover 22.

To be more specific, as shown in FIGS. 10 to 15, the exhaust manifold cover 22 is formed using as many curved portions as possible to match the shapes of the first to fourth branch pipes 4-1, 4-2, 4-3 and 4-4. In this case, the cover 22 also conforms to the external form of the large capacity pipe portion 20 described in the first embodiment.

Figure 15:
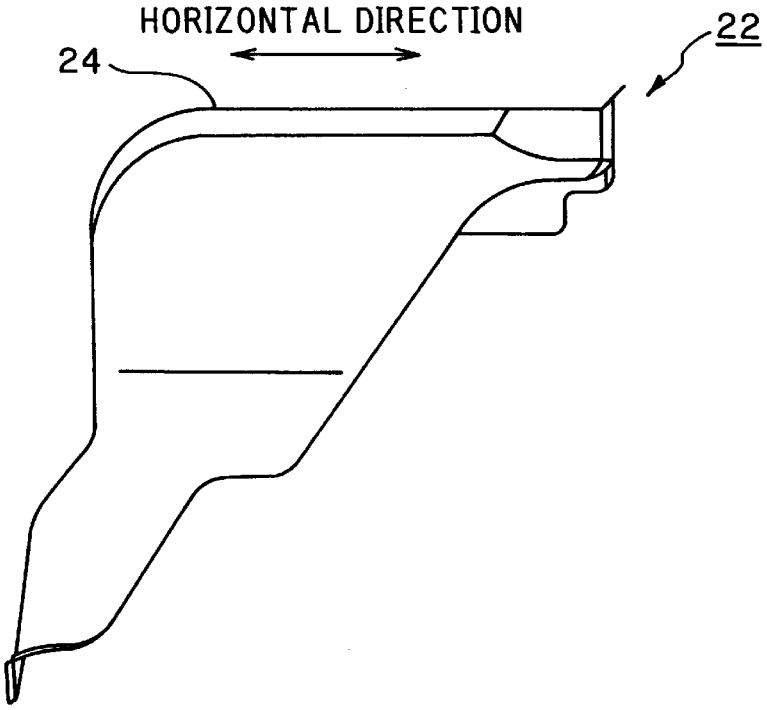
FIG. 15 is a right side view thereof.
Figure 16:
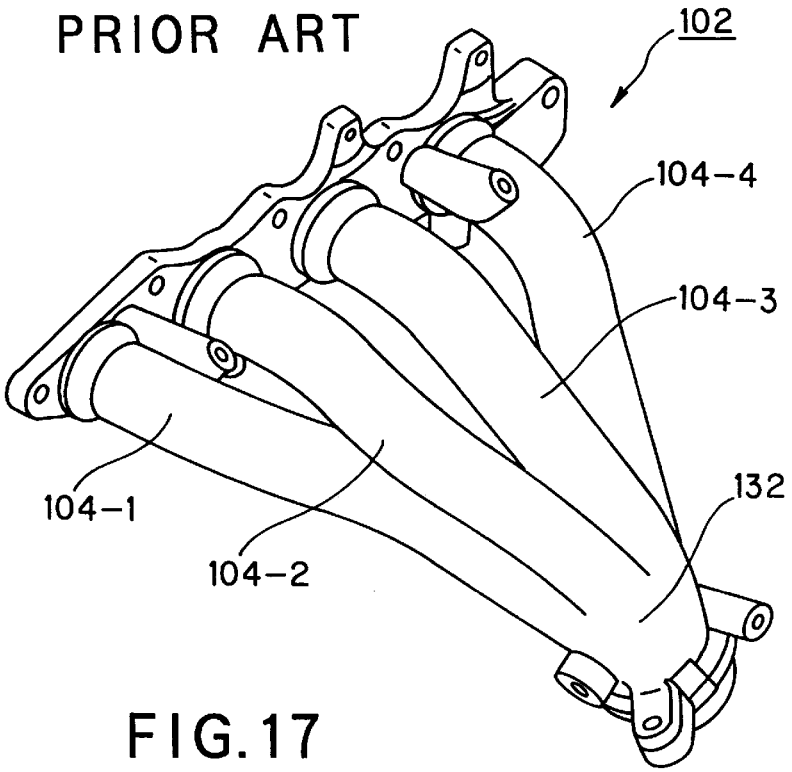
FIG. 16 PRIOR ART
FIG. 16 is a schematic perspective view of a first conventional exhaust manifold.
Figure 17:
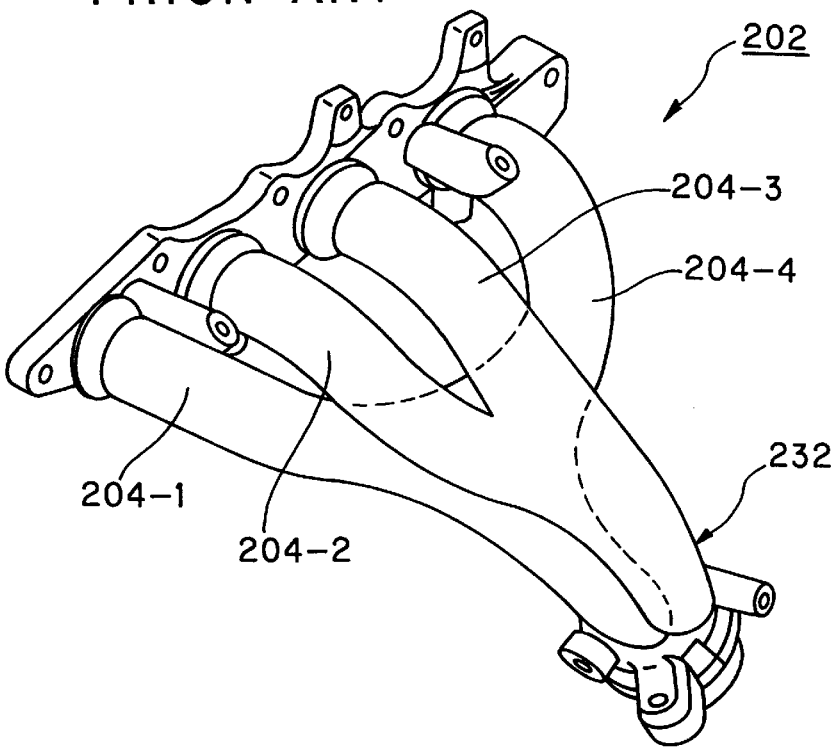
FIG. 17 PRIOR ART
FIG. 17 is a schematic perspective view of a second conventional exhaust manifold.
Figure 18:
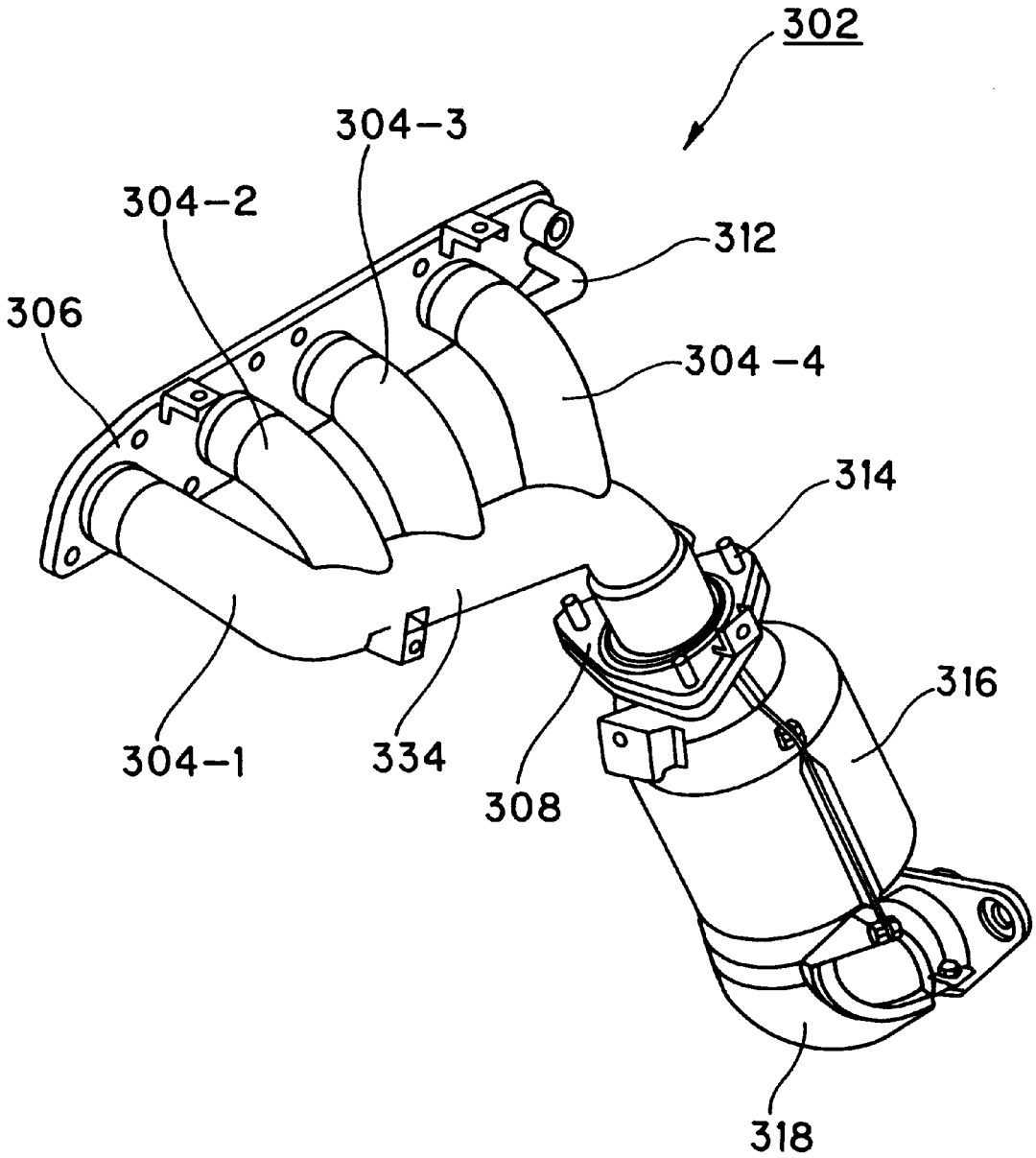
FIG. 18 PRIOR ART
FIG. 18 is a schematic perspective view of a third conventional exhaust manifold.
Figure 19:
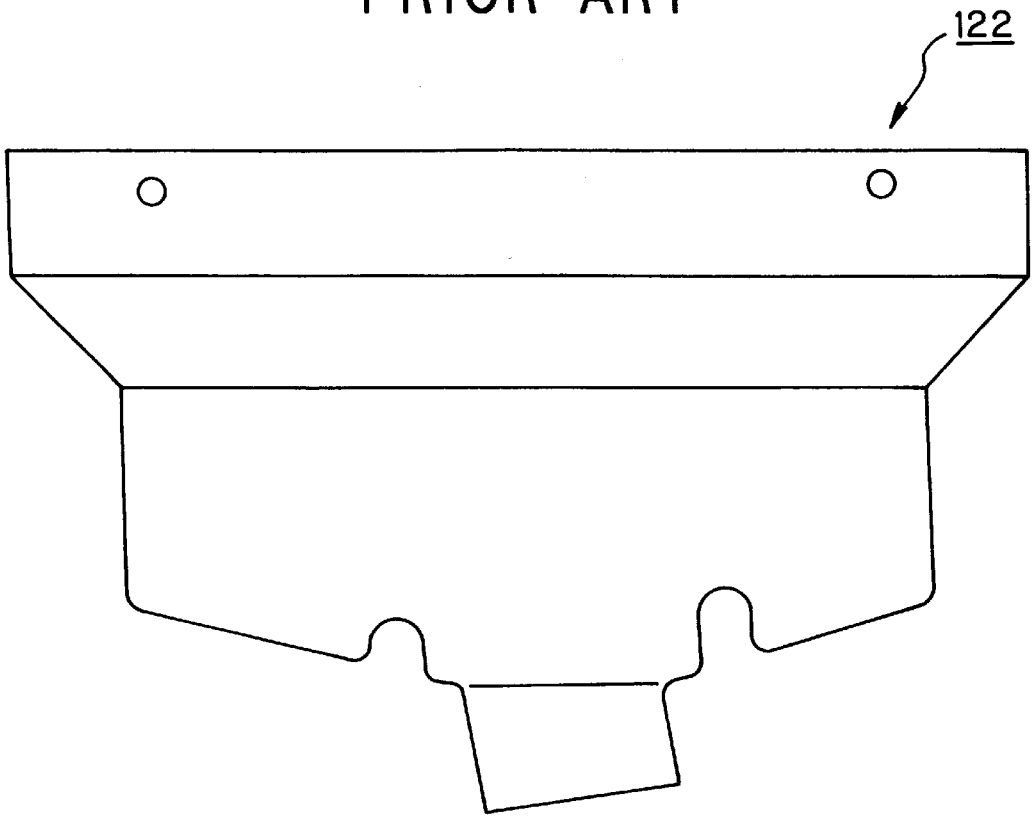
FIG. 19 PRIOR ART
FIG. 19 is a front view of a conventional exhaust manifold cover.
Figure 20:
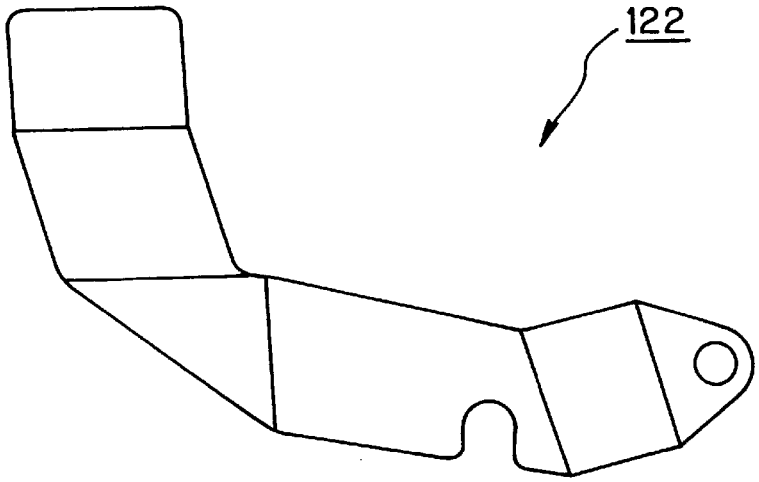
FIG. 20 PRIOR ART
FIG. 20 is a right side view thereof.

After the formation of the exhaust manifold cover 22, the horizontally extending planar portion 24 is formed on an upper part of the exhaust manifold cover 22, as shown in FIG. 15.

Figure 11:
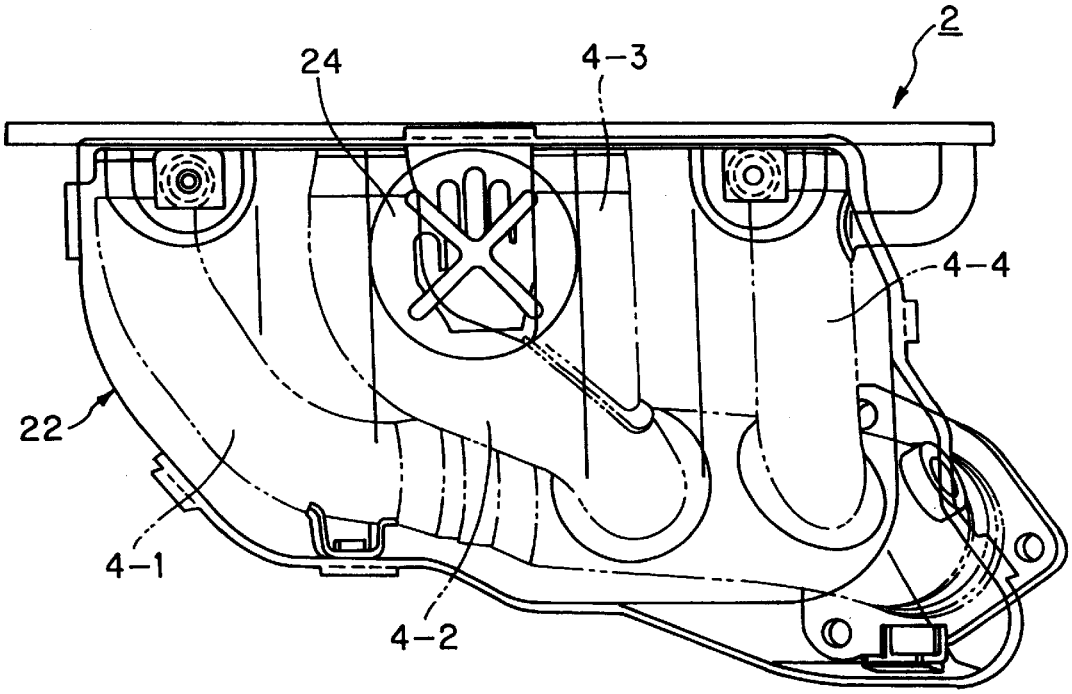
FIG. 11 is a plan view thereof.
Figure 12:
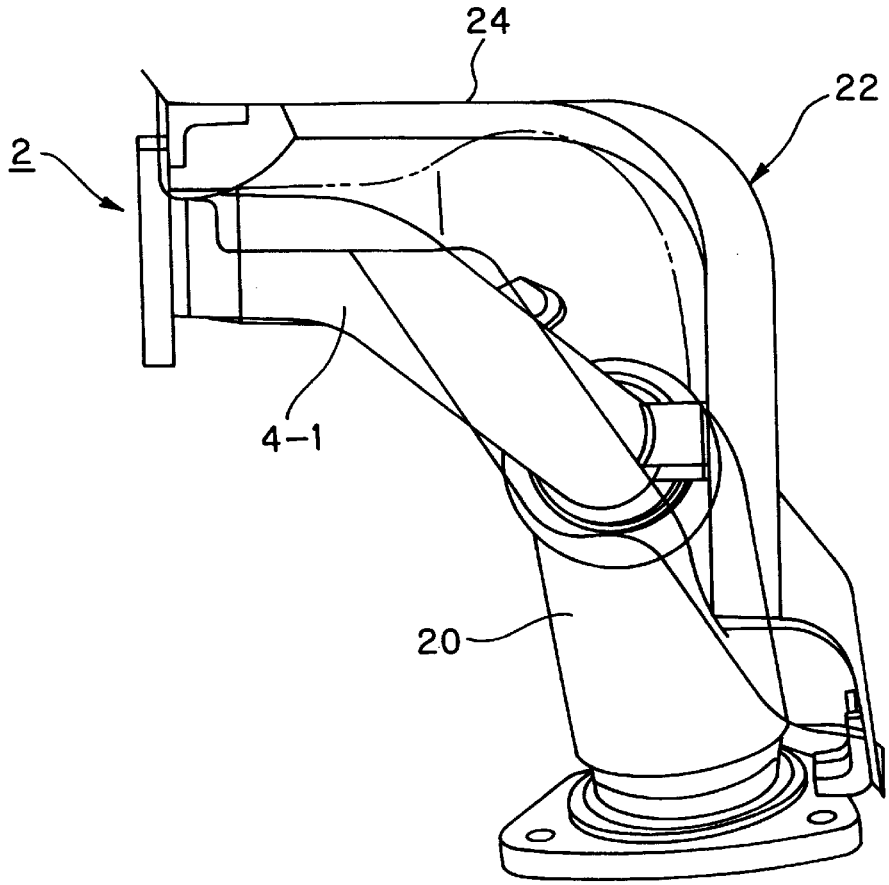
FIG. 12 is a left side view thereof.
Figure 13:
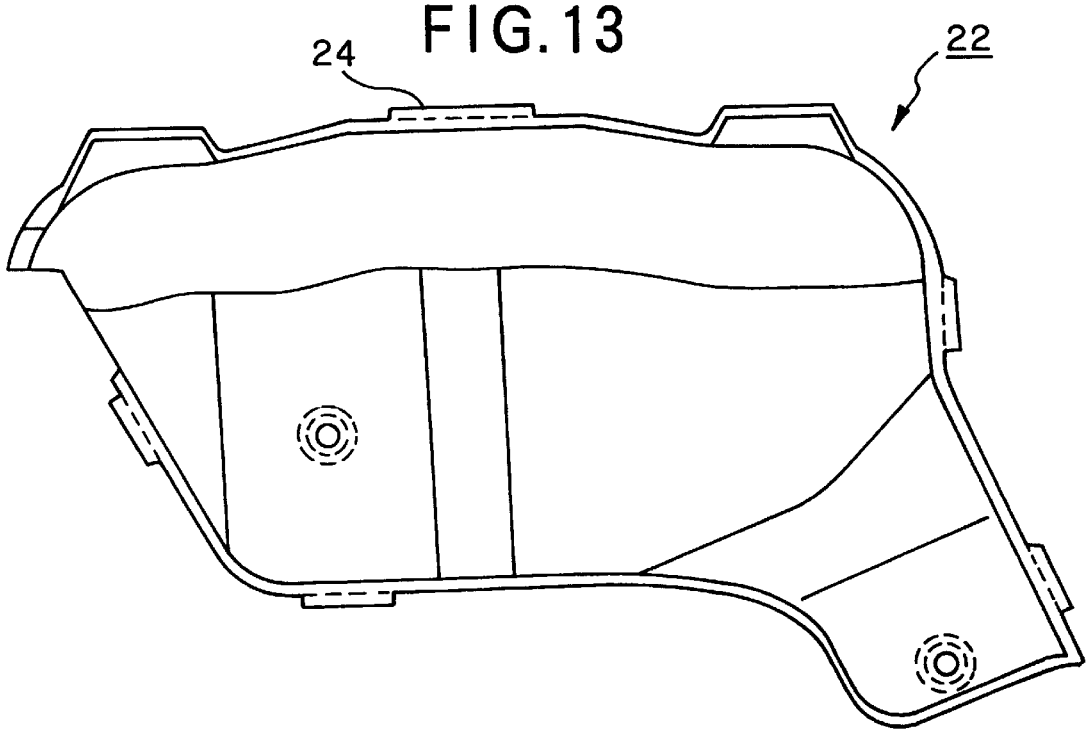
FIG. 13 is a front view of the exhaust manifold cover.
Figure 14:
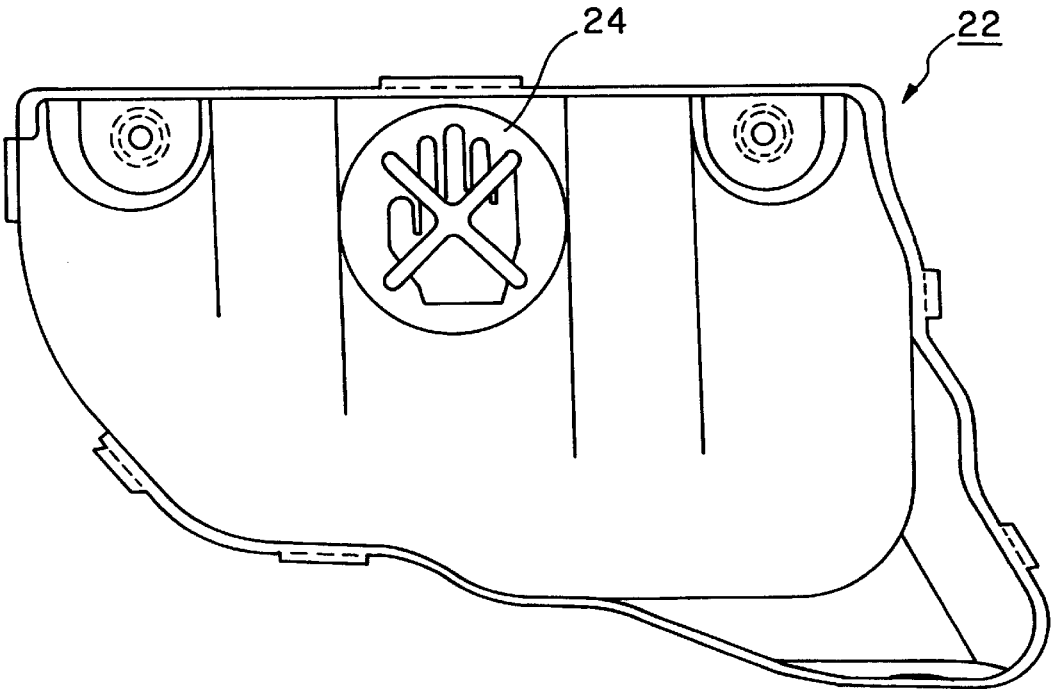
FIG. 14 is a plan view thereof.

As shown in FIGS. 11 and 14, the planar portion 24 functions as a space for the placement of information such as instructions or an operating method.

Since the exhaust manifold cover 22 for covering the exhaust manifold 2 is formed in conformity with the shapes of the first to fourth branch pipes 4-1, 4-2, 4-3 and 4-4, it is possible to improve the strength of the cover 22 advantageously in practical use and it is also possible to attain improvement in appearance.

Further, since the planar portion 24 is formed on an upper part of the exhaust manifold cover 22, the space for placement of information such as instructions or an operating method is enlarged, and thus is more visible, so that greater attention is paid to the information.

According to the present invention, as described in detail hereinabove, there is provided an exhaust manifold assembly in an internal combustion engine, the assembly having an exhaust manifold attached to the internal combustion engine having a plurality of cylinders, and a manifold cover is disposed to shut out heat and sound from the exhaust manifold, the exhaust manifold having branch pipes respectively provided with branched exhaust passages in communication with exhaust ports of the internal combustion engine, wherein the exhaust manifold is a one-point junction type manifold, and a large capacity portion is formed at the junction of the branch pipes, the large capacity portion having a flow capacity larger than the flow capacity of each branch pipe. With the large capacity portion, it is possible to eliminate exhaust interference and improve both torque and output, which is advantageous in practical use. Further, the provision of the large capacity portion in the exhaust manifold permits reduction in size, or in length, of the exhaust manifold, whereby the occupied space can be diminished as a whole. For example, even if the exhaust manifold is formed as a manifold-converter type, it is not likely that restrictions may be imposed on the layout thereof.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An exhaust manifold assembly for an internal combustion engine having a plurality of cylinders and exhaust ports, the assembly having an exhaust manifold attached to the internal combustion engine, and a manifold cover disposed to shut out heat and sound from the exhaust manifold, said exhaust manifold having a plurality of branch pipes respectively provided therein with branch exhaust passages in communication with exhaust ports of the internal combustion engine, wherein said exhaust manifold is a one-point junction type manifold and has an elongate tubular member provided at a junction of said branch pipes, said tubular member having a flow capacity greater than the flow capacity of each said branch pipe, said tubular member terminating at opposite inlet and outlet end portions each defining an opening therein, said tubular member including an outer peripheral tubular wall extending between said inlet and outlet end portions, an outlet end of a first said branch pipe being connected to said inlet end portion, an outlet end of a second said branch pipe being connected to said outer wall and an outlet end of a third said branch pipe being connected to a side of said second branch pipe such that said third branch pipe communicates with said tubular member via said outlet and of said second branch pipe, said flow capacity of said second branch pipe being greater than said flow capacity of said third branch pipe, an outlet end of a fourth said branch pipe being connected to said outer wall, said second and third branch pipes being disposed between said first and fourth branch pipes.

2. The exhaust manifold assembly according to claim 1, wherein said tubular member curves toward said second, third and fourth branch pipes and said inlet end portion is remote from said outlet end portion such that all of the branch pipes of said exhaust manifold are substantially equal in length, and said tubular member has an inner passage with a passage diameter larger than a diameter of the exhaust passage of each said branch pipe.

3. The exhaust manifold assembly according to claim 1, wherein said exhaust manifold cover is separate from said exhaust manifold and has a shape which conforms to a shape of each said branch pipe and has an upper planar portion for placement of information thereon.

4. The exhaust manifold assembly of claim 1 wherein said outlet ends of said second and fourth branch pipes are connected to said outer wall so as to discretely open into an interior of said tubular member.

5. The exhaust manifold assembly of claim 1 wherein said second, third and fourth branch pipes communicate with an interior of said tubular member in a transverse manner.

6. An exhaust manifold assembly for discharge of exhaust gas from an internal combustion engine having a plurality of cylinders and exhaust ports associated therewith, said assembly comprising:

an exhaust manifold having a plurality of exhaust pipes each having an inlet end for connection to a corresponding exhaust port of the internal combustion engine, each said exhaust pipe defining therein an exhaust passage in communication with the corresponding exhaust port of the internal combustion engine; and an elongate tubular member forming a junction of outlet ends of said exhaust pipes, said tubular member having a passage formed therein in communication with said exhaust passages of said exhaust pipes, a diameter of said passage of said tubular member being greater than a diameter of each said exhaust passage of the respective exhaust pipes, said tubular member terminating at opposite inlet and outlet end portions each defining an opening therein, said tubular member including a tubular wall portion extending between said inlet and outlet end portions, said outlet end of a first said exhaust pipe being connected to said inlet end portion for communication with said passage of said tubular member, said outlet end of a second said exhaust pipe being connected to said outer wall and said outlet end of a third said exhaust pipe being connected to a side of said second exhaust pipe such that said third exhaust pipe communicates with said passage of said tubular member via said outlet end of said second exhaust pipe, said diameter of said exhaust passage of said second exhaust pipe being greater than said diameter of said exhaust passage of said third exhaust pipe, said outlet end of a fourth said exhaust pipe being connected to said outer wall, said second and third exhaust pipes being disposed between said first and fourth exhaust pipes, said second and third exhaust pipes, and said fourth exhaust pipe communicating with said passage of said tubular member via respective discrete and spaced-apart openings in said tubular member to provide separate flows of exhaust gas thereinto.

7. The exhaust manifold assembly of claim 6, wherein said outlet end portion of said tubular member is disposed adjacent a catalytic converter and said wall portion is arcuately curved between said inlet and outlet end portions.

8. The exhaust manifold assembly of claim 7, wherein said outlet end of said second exhaust pipe is connected to said arcuately curved wall portion of said tubular member.

9. The exhaust manifold assembly of claim 8, wherein said outlet end of said fourth exhaust pipe is connected to said arcuately curved wall portion of said tubular member adjacent said outlet end portion thereof.

10. The exhaust manifold assembly of claim 6, further comprising an exhaust manifold cover separate from said exhaust pipes and said tubular member, said exhaust manifold cover being disposed to prevent the escape of heat and sound generated by said exhaust manifold to the outside environment, said exhaust manifold cover having a shape conforming to a shape of each said exhaust pipe, said exhaust manifold cover having a planar part at an upper portion thereof for the placement of information thereon.

11. The exhaust manifold assembly of claim 6 wherein the diameter of said exhaust passage of said second exhaust pipe is greater than the diameters of said exhaust passages of the respective first, third and fourth exhaust pipes.

12. The exhaust manifold assembly of claim 6 wherein said exhaust passages of the respective exhaust pipes are separate from one another along major lengths thereof.

* * * * *

UNITED STATES PATENT AND TRADEMARK OFFICE

CERTIFICATE OF CORRECTION

PATENT NO. : 6,009,706

DATED : January 4, 2000

INVENTOR(S) : Hiroaki HANEDA

It is certified that error appears in the above-indentified patent and that said Letters Patent is hereby corrected as shown below:

Column 7, line 38, change "and" to --end --.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*